United States Patent [19]

Mayer et al.

[11] Patent Number: 4,498,124

[45] Date of Patent: Feb. 5, 1985

[54] DUAL HALOGEN LAMP ASSEMBLY

[75] Inventors: William Mayer; Alton E. Runions, both of Rochester, Ill.

[73] Assignee: Stewart-Warner Corporation, Chicago, Ill.

[21] Appl. No.: 392,337

[22] Filed: Jun. 28, 1982

[51] Int. Cl.[3] ..... F21M 3/30

[52] U.S. Cl. ..... 362/211; 362/61; 362/240; 362/247; 362/297; 362/310; 362/346; 362/347; 362/368

[58] Field of Search ..... 362/61, 80, 240, 306, 362/368, 297, 346, 347, 235, 310, 247, 211, 212; 313/1, 3, 407, 409, 113–115; 315/82, 83

[56] References Cited

U.S. PATENT DOCUMENTS

| | | | |
|---|---|---|---|
| 1,244,990 | 10/1917 | Koch | 362/240 X |
| 2,370,823 | 3/1945 | Trautner | 362/240 X |
| 3,071,706 | 1/1963 | Waldorf | 313/1 X |
| 3,375,363 | 3/1968 | Rignders et al. | 362/211 |
| 3,617,795 | 11/1971 | Peek | 315/83 X |
| 3,908,144 | 9/1975 | Rudd | 313/115 X |
| 4,070,594 | 1/1978 | Fuchi et al. | 362/225 X |
| 4,225,906 | 9/1980 | Gulliksen et al. | 362/240 X |
| 4,277,818 | 7/1981 | Urbanek et al. | 362/61 |
| 4,300,189 | 11/1981 | Shanks | 362/80 X |
| 4,364,101 | 12/1982 | Brockmeyer | 362/80 |

FOREIGN PATENT DOCUMENTS

| | | | |
|---|---|---|---|
| 2537208 | 2/1977 | Fed. Rep. of Germany | 362/61 |
| 1319391 | 1/1962 | France | 315/83 |

*Primary Examiner*—Peter A. Nelson

*Attorney, Agent, or Firm*—A. G. Douvas

[57] ABSTRACT

A dual halogen bulb rectangular lamp assembly with a one-piece plastic reflector having two adjacent paraboloidal mirrorized inner surfaces. A halogen bulb unit is mounted in each of the mirrorized surfaces and they are electrically connected in series for simultaneous bulb energization.

8 Claims, 7 Drawing Figures

DUAL HALOGEN LAMP ASSEMBLY

BACKGROUND OF THE INVENTION

Vitreous glass sealed beam lamp units have been used for vehicle lighting since at least the 1930's in the United States. These lamps generally include a paraboloidal reflector having a highly mirrorized inner surface that usually has two central openings that receive connectors for a filament aligned within the reflector. The reflector is enclosed by a circular convex lens also constructed of glass that is located with respect to the reflector by various types of integral locating tabs and is joined to the reflector by heat fusion. The connector assemblies are also usually connected to the reflector by a heat fusion process, and the composition and pressure of gas within the reflector-lens envelope are carefully controlled through a filling tube formed integrally with the reflector, and thils tube is fused after evacuation and/or, inert gas filling of the lamp envelope. Controlling the atmosphere within the envelope through the filling tube is extremely costly, and the filling tube must be carefully fused at the proper instant to achieve the desired atmosphere within the envelope.

Such a sealed beam lamp unit is shown and described in the D. K. Right U.S. Pat. No. 2,148,312 dated Feb. 21, 1939.

These sealed beam lamp units, which must be replaced after the filaments burn out, require complicated locking rings and adjustment assemblies, permanently carried by the associated vehicle to hold them in proper position. The locking rings frequently include adjusting brackets for varying the attitude of the lamp units to properly adjust the lamp's beam to achieve the desired lamp alignment.

It has been suggested that the reflector of a rectangular sealed beam lamp unit be constructed of a plastic material with support flanges formed integrally with the plastic to eliminate the complicated mounting flanges and rings required in prior lamp units. Such a construction is shown in the Thomas T. Talon et al U.S. Pat. No. 4,188,655. This patent discloses a lamp with three integral flanges on a plastic reflector that cooperate with three adjusting assemblies mounted to the vehicle that permit adjustment of the lamp beam in two orthogonal planes. While such an arrangement is suitable for many passenger automobile applications it is nevertheless quite costly because of the three separate fastening and adjusting mechanisms required.

Because of the many problems in manufacturing vitreous sealed beam lamp units, halogen bulb units have become increasingly popular over the last several years. In halogen bulb lamp units, a halogen bulb sub-assembly is constructed that consists of a sealed gas filled bulb having leads, that provides high intensity illumination for the lamp. Because the halogen bulb sub-assembly is itself sealed, it is not necessary to accurately control the gas content within the reflector of these halogen bulb lamp assemblies and for that reason, among others, the manufacturing process is considerably simplified.

Many vehicles, particularly heavy trucks and large, off-the-road construction equipment, have 24-volt electrical systems which require 24-volt lamp assemblies. The filament required in a 24-volt halogen bulb is very tightly coiled and this increases the likelihood of adjacent coil turns in the filament contacting one another under even normal vibration occurring in the vehicular environment particularly in heavy trucks and off-the-road vehicles. When one or more of these adjacent coil turns of the filament comes in contact with another the resistance of the filament goes low, resulting in bulb burn-out. Thus, it has been found extremely difficult to manufacture a 24-volt halogen bulb sub-assembly for vehicular lamp units.

It is, therefore, a primary object of the present invention to provide a 24-volt vehicle halogen bulb lamp assembly that ameliorates the problems noted above with prior known 24-volt halogen bulb lamp units.

SUMMARY OF THE PRESENT INVENTION

According to the present invention, a high voltage dual halogen bulb rectangular lamp assembly is provided that is far more rugged and durable than single bulb high voltage halogen bulb lamp asemblies. These objectives are basically accomplished through the provision of a lamp assembly that has two separate 12-volt halogen bulbs connected in series to provide the 24-volt requirement for vehicles having 24-volt electrical systems.

The use of two-12-volt halogen bulb sub-assemblies in the present lamp assembly significantly reduces the possibility of bulb burn-out because the filaments required in 12-volt halogen bulb units are coiled much more loosely and the coil turns are spaced apart significantly farther than the filaments required in 24-volt halogen bulb units. Filament coil turn contact causes the resistance of the filament to go low, resulting in bulb burn-out and thus, bulb burn-out is reduced in the present lamp because the 12-volt coil turns are much less likely to come in contact with one another.

Toward these ends, the present lamp assembly is provided with a one-piece plastic reflector constructed of an impact resistant polyester material such as "Petlon" manufactured by Mobay Chemical Company. This plastic reflector has a generally rectangular configuration with integral upper and lower highly mirrorized paraboloidal inner surfaces, each of which reflects light from one of two halogen bulb units mounted in the lamp through a front mounted rectangular lens constructed of either plastic or vitreous glass material. The lens, rather than being fused to the reflector as in vitreous glass sealed beam lamps, is joined to the reflector by an epoxy adhesive in a forwardly opening rectangular recess in the reflector.

The two halogen lamp sub-units each have parallel spaced connector pins that during manufacture are coated with an epoxy adhesive and inserted through parallel spaced stepped bores formed centrally in each of the paraboloidal inner surfaces of the reflector. The reflector and lens assembly is then baked in an oven at a temperature and for a time sufficient to cure the epoxy material and permanently bond the halogen bulb units to the reflector, as well as the lens to the reflector. The temperature required to cure the epoxy adhesive for the lamps do not alter the position of the halogen bulb units in the reflector nor cause distortion of the mirrorized reflector paraboloidal surfaces, and thus the significant distortion problem that occurs durng the manufacture of vitreous sealed beam lamp units does not occur in this new lamp. This elimination of distortion is a very important advantage because distortion changes the optical alignment of the lamp.

The halogen lamp units are aligned prior to assembly into the reflector with the optical axes of the paraboloidal inner surfaces of the reflector. The paraboloidal surfaces on the reflector are generally rectangular in outer configuration when viewed from the front of the reflector and toward this end the upper paraboloidal surface of the reflector has a generally flat top wall and the lower paraboloidal surface has a generally flat bottom wall. The juncture between the two paraboloidal surfaces approximately centrally of the reflector forms a peak that is sufficiently to the rear of the halogen bulb units so that part of the light eminating from each halogen bulb unit is reflected by the paraboloidal mirrorized surface associated with the other halogen bulb unit. Because of the relatively close positioning of the two halogen bulb units, most of this cross-over light is projected forwardly through the lens along or parallel to the optical axes of the two paraboloidal reflector surfaces.

DETAILED DESCRIPTION OF THE PREFERRED EMBODIMENT

Figure 1:
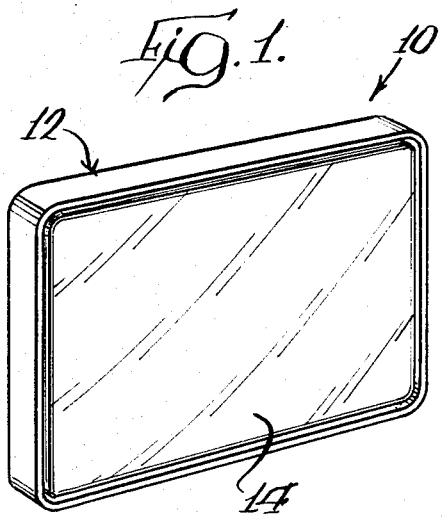
FIG. 1 is a perspective view of a halogen bulb lamp assembly according to the present invention.
Figure 2:
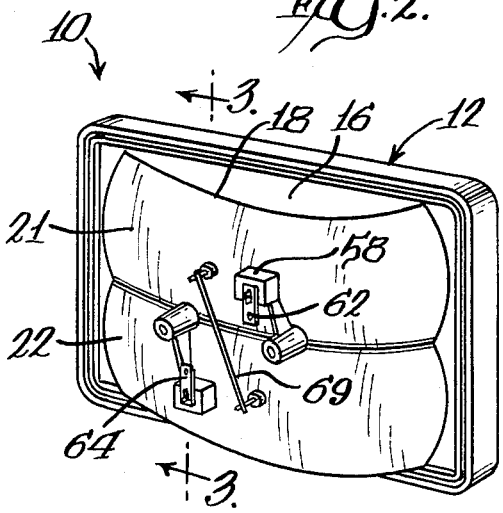
FIG. 2 is a rear perspective view of the halogen bulb lamp assembly illustrated in FIG. 1.
Figure 3:
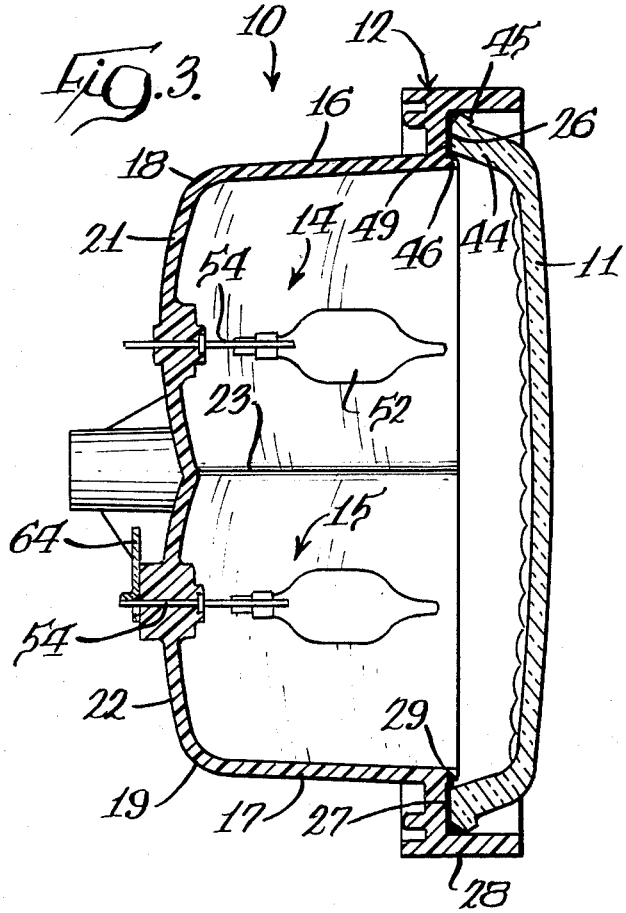
FIG. 3 is an enlarged longitudinal section taken generally along line 3—3 of FIG. 2.

Referring to the drawings and particularly FIGS. 1 to 3, a rectangular sealed beam halogen bulb unit 10 is illustrated generally including a one-piece plastic reflector 12 with upper and lower halogen bulb units 14 and 15 mounted therein enclosed by a vitreous glass or plastic rectangular lens 11.

The reflector 12 is constructed entirely of a one-piece plastic molding of an impact resistant plastic. One plastic that has been found particularly suitable is a polyester plastic "Petlon" manufactured by Mobay Chemical Company. This plastic is durable, shock resistant and it also withstands a broad range of temperature variations.

The plastic reflector 12 includes generally flat top and bottom walls 16 and 17 having arcuate rear ends 18 and 19 connected together by adjacent substantially identical upper and lower paraboloidal walls 21 and 22. The paraboloidal walls 21 and 22 meet on a line 23 lying in a horizontal plane midway between top and bottom walls 16 and 17, that is itself paraboloidal in shape. The inner surfaces of walls 16, 17, 21 and 22 are mirrorized by metalic vacuum deposition or other suitable process to provide the necessary reflective characteristics for the interior of the reflector 12 to direct and focus light, emitting from each of the bulb assemblies 14 and 15 forwardly from the lamp assembly along the geometric axes of the paraboloidal walls 21 and 22.

The paraboloidal line of juncture 23 between the paraboloidal surfaces 21 and 22 minimizes light loss from the halogen lamp units 14 and 15 and while some of the light emitting from halogen lamp unit 14 will be reflected by walls 17 and 22, and similarly some of the light emitting from halogen lamp unit 15 will be reflected by the walls 16 and 21, most of this light will be projected forwardly along the axes of the paraboloidal surfaces 21 and 22 as useful light.

The forward end of reflector 12 has a forwardly opening lens recess 26 that is defined by outwardly extending integral wall 27, forwardly extending integral wall 28, and a rim 29 extending forwardly from the walls 16 and 17. The walls 27, 28 and rim 29 extend peripherally completely around the reflector 12. Wall 28 serves not only to define in part recess 26 but also forms a hood or shield around lens 11 to protect the lens and to limit stray light emission from the lamp unit in a direction perpendicular to the dual axes of the unit.

The lens 11 may be constructed of vitreous glass or plastic, either transparent or translucent and is seen to have an outer peripheral rim 44 having a beveled rear surface 45 and an inner corner recess 46 that fits over and seats against the end of projecting rim 29. An epoxy adhesive 49 extends all around recess 26 and firmly bonds the lens 14 to reflector 12.

Figure 4:
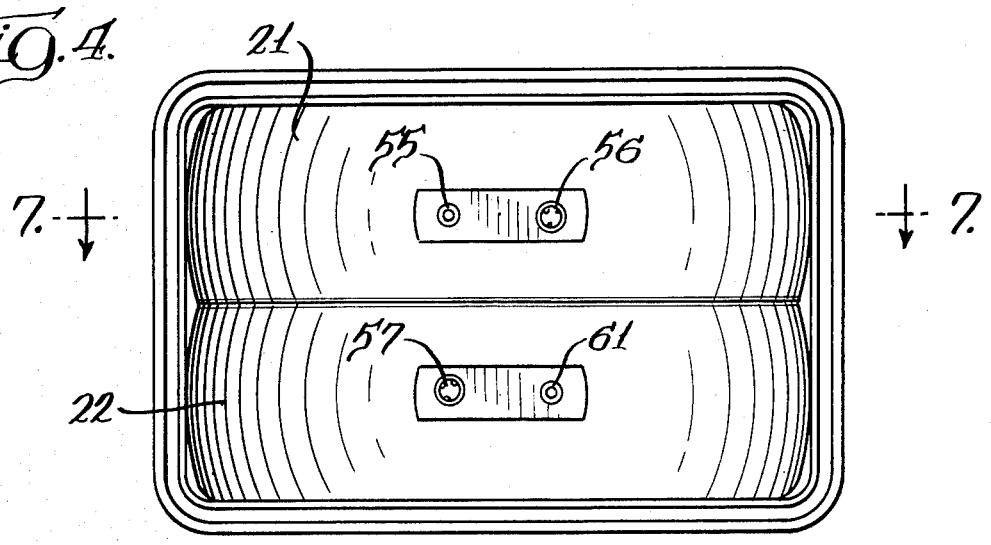
FIG. 4 is a front view of a reflector in the present halogen bulb lamp assembly with the lens and halogen bulb units removed.

Each of the halogen bulb units 14 and 15 is identical and includes a halogen bulb 52 with leads welded to a pair of identical spaced and parallel connector pins 54. The connector pins 54 are mounted with a suitable epoxy adhesive in a pair of spaced parallel mounting bores 55 and 56 in wall 21 and bores 57 and 61 in wall 22, see FIGS. 4 and 5, that extend completely through the reflector. Bores 55 and 61 extend through integral rectangular bosses 58 and 63 on the rear of the reflector, and bores 56 and 57 extend through integral cylindrical bosses 59 and 66 on the rear of the reflector as seen most clearly in FIGS. 2 and 5. Rectangular bosses 58 and 63 have molded in grooves 59 and 60 for receiving holding projections on terminals 62 and 64 seen in FIG. 2. Terminals 62 and 64 are electrically connected to the projecting ends of the connector pins in reflector bores 55 and 61.

Figure 5:
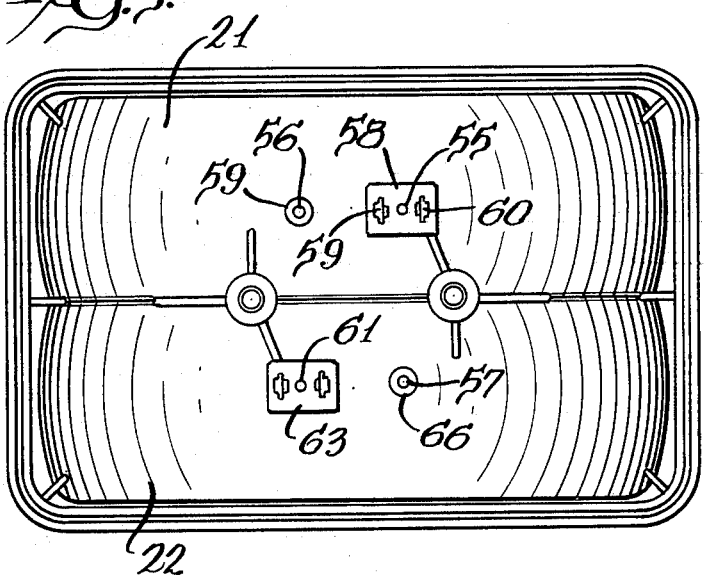
FIG. 5 is a rear view of the reflector illustrated in FIG. 4 with the terminals illustrated in FIGS. 2 and 3 removed.
Figure 6:
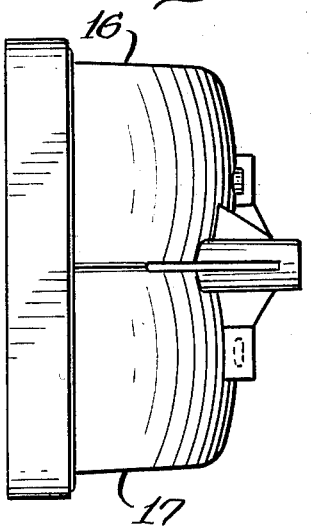
FIG. 6 is the right side view of the reflector illustrated in FIG. 5.
Figure 7:
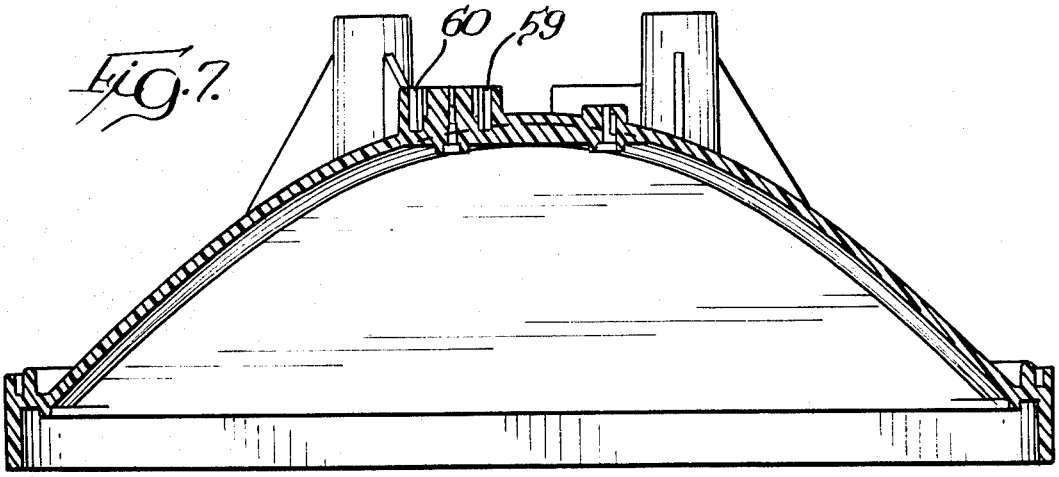
FIG. 7 is an enlarged cross-section of the reflector according to the present invention taken generally along line 7—7 of FIG. 4.

As seen in FIG. 5, the rectangular bosses 58 and 63 and cylindrical bosses 59 and 66 are reversed on the upper and lower paraboloidal walls 21 and 22.

As seen clearly in FIG. 2, the connector pins 54 projecting through the cylindrical bosses 59 and 66 are electrically connected together by a wire conductor 69 and it connects the bulb units 14 and 15 in series. The bulbs when applied with a suitable 24-volt source across terminals 62 and 64 will energize both of the 12-volt bulbs simultaneously.

We claim:

1. A dual halogen bulb rectangular lamp assembly comprising: a reflector having a first paraboloidal surface and a second paraboloidal surface positioned in the same vertical plane and below the first paraboloidal surface, halogen bulb assemblies connected permanently at the reflector in series for simultaneous energization mounted substantially centrally in each of the first and second paraboloidal surfaces of the reflector to reduce the voltage requirements of each bulb assembly, and a lens mounted over the reflector with an unobstructed area between each of the bulb assemblies and the lens.

2. A dual halogen bulb rectangular lamp assembly, comprising; a one-piece plastic reflector having a generally rectangular outer perimeter, said reflector having a first paraboloidal mirrorized surface in the upper portion thereof and having a second paraboloidal mirrorized surface in the lower portion thereof, each of said mirrorized surfaces being horizontally elongated with a generally rectangular outer configuration, said first and second paraboloidal surfaces being substantially identical and having vertically spaced parallel optical axes, substantially identical low voltage halogen bulb units with relativey loosely coiled filaments permanently connected at the reflector in series for simultaneous energization mounted in each of the first and second paraboloidal surfaces in the reflector to reduce the voltage requirement for each bulb unit, means for simultaneously energizing the bulb units whereby the lamp assembly provides illumination equivalent to a higher voltage bulb unit with a tightly coiled filament, and a single lens enclosing the reflector and the two halogen bulb units.

3. A dual halogen bulb rectangular lamp assembly as defined in claim 2, wherein each of the halogen bulb units has a pair of electrical conducting connector pins, conductor means electrically connecting one of the pins in one unit to one of the pins in the other unit so the bulb units are connected in series to operate simultaneously.

4. A dual halogen bulb rectangular lamp assembly as defined in claim 1, including means electrically connecting the halogen bulb assemblies in series.

5. A dual halogen bulb lamp assembly, comprising; a one-piece plastic reflector having a rectangular outer configuration, said reflector having an integral upper reflector portion with a mirrorized paraboloidal inner surface and having an integral lower reflector portion with a mirrorized paraboloidal inner surface, said first and second paraboloidal surfaces being substantially identical and having vertically spaced parallel optical axes, each of said reflector portions having a generally rectangular shape when viewed from the front of the lamp assembly, substantially identical low voltage halogen bulb units with relatively loosely coiled filaments mounted in each of the reflector portions substantially on the optical axes of the associated paraboloidal inner surfaces, means at the reflector permanently electrically connecting the halogen bulb units in series so the bulb units are energized simultaneously whereby the lamp assembly provides illumination equivalent to a higher voltage bult unit with a tightly coiled filament, and a single lens enclosing the reflector.

6. A dual halogen bulb lamp assembly, comprising; a one-piece plastic reflector having a rectangular outer configuration, said reflector having an integral upper reflector portion with a mirrorized paraboloidal inner surface and having an intergral lower reflector portion with a mirrorized paraboloidal inner surface, said first and second paraboloidal surfaces being substantially identical and having vertically spaced parallel optical axes, each of said reflector portions having a generally rectangular shape when viewed from the front of the lamp assembly, substantially identical low voltage halogen bulb units mounted in each of the reflector portions substantially on the optical axes of the associated paraboloidal inner surfaces, means at the reflector permanently electrically connecting the halogen bulb units in series, so the bulb units are energized simultaneously whereby the lamp assembly provides illumination equivalent to a higher voltage bulb unit with a tightly coiled filament, a rectangular groove in the forward end of the reflector, a rectangular lens having a rearwardly projecting peripheral flange in the groove in the forward end of the reflector, and an epoxy adhesive in the groove for bonding the lens flange to the reflector.

7. A dual halogen bulb lamp assembly, comprising; a one-piece plastic reflector having a rectangular outer configuration, said reflector having an integral upper reflector portion with a mirrorized paraboloidal inner surface and having an integral lower reflector portion with a mirrorized paraboloidal inner surface, each of said reflector portions having a generally rectangular shape when viewed from the front of the lamp assembly, a halogen bulb unit mounted in each of the reflector portions substantially on the optical axes of the associated paraboloidal inner surfaces, each of the halogen bulb units including a pair of connector pins, each of the reflector portions having a pair of spaced through bores therein receiving the connector pins of the associated halogen bulb unit, epoxy adhesive in each of the reflector portion bores for bonding the bulb units to the reflector, said connector pins projecting from the rear of the reflector, conductor means connecting one of the connector pins of both of the halogen bulb units together so the bulb units are connected in series, and a single lens covering the reflector.

8. A dual halogen bulb lamp assembly, comprising: a one-piece plastic reflector having a rectangular outer configuration, said reflector having an integral upper reflector portion with a mirrorized paraboloidal inner surface and having an integral lower reflector portion with a mirrorized parapboloidal inner surface, each of said reflector portions having a generally rectangular shape when viewed from the front of the lamp assembly, a halogen bulb unit mounted in each of the reflector portions substantially on the optical axes of the associated praboloidal inner surfaces, each of the halogen bulb units including a pair of connector pins, each of the reflector portions having a pair of spaced through bores therein receiving the connector pins of the associated halogen bulb unit, epoxy adhesive in each of the reflector portion bores for bonding the bulb units to the reflector, a conductor connecting one of the connector pins of both of the halogen bulb units together so that the bulb units are connected in series, a rectangular groove in the forward end of the reflector, a rectangular lens having a rearwardly projecting peripheral flange in the groove in the forward end of the reflector, and an epoxy adhesive in the groove for bonding the lens flange to the reflector.

* * * * *